US011156108B2

(12) United States Patent
Negri

(10) Patent No.: US 11,156,108 B2
(45) Date of Patent: Oct. 26, 2021

(54) MULTI-BLADE VANE FOR A TURBOMACHINE ROTOR AND ROTOR COMPRISING SAME

(71) Applicant: SAFRAN AIRCRAFT ENGINES, Paris (FR)

(72) Inventor: Arnaud Nicolas Negri, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/770,856

(22) PCT Filed: Dec. 12, 2018

(86) PCT No.: PCT/EP2018/084462
§ 371 (c)(1),
(2) Date: Jun. 8, 2020

(87) PCT Pub. No.: WO2019/115578
PCT Pub. Date: Jun. 20, 2019

(65) Prior Publication Data

US 2020/0392855 A1 Dec. 17, 2020

(30) Foreign Application Priority Data

Dec. 13, 2017 (FR) ..... 1762028

(51) Int. Cl.
*F01D 5/30* (2006.01)
*F01D 5/02* (2006.01)
(Continued)

(52) U.S. Cl.
CPC ..... *F01D 5/3007* (2013.01); *F01D 5/02* (2013.01); *F01D 5/146* (2013.01); *F04D 29/322* (2013.01);
(Continued)

(58) Field of Classification Search
CPC ..... F01D 5/3007; F01D 5/3015; F01D 5/146; F04D 29/322; F04D 29/34;
(Continued)

(56) References Cited

U.S. PATENT DOCUMENTS 5,735,673 A * 4/1998 Matheny ..... F01D 5/282 416/223 A
2004/0219024 A1 11/2004 Soupizon et al.
(Continued)

FOREIGN PATENT DOCUMENTS

| | | |
|---|---|---|
| EP | 1447525 A1 | 8/2004 |
| EP | 1881163 A1 | 1/2008 |
| WO | 2014/076407 A1 | 5/2014 |

OTHER PUBLICATIONS

International Search Report for PCT Patent Application No. PCT/EP2018/084462, dated Feb. 21, 2019, 5 pages (2 pages of English Translation and 3 pages of Original Document).

*Primary Examiner* — Christopher Verdier
(74) *Attorney, Agent, or Firm* — Womble Bond Dickinson (US) LLP

(57) ABSTRACT

A vane (1) for a turbomachine rotor having a first blade (2) and a second blade (3). A platform (4) forms an angular wall sector in an axial direction (X), with the two blades (2, 3) connected to the platform (4). Two individual supports (12, 13), extend from the platform (4), and bear an attachment member (16, 17) at an end opposite the platform (4). The attachment member extends parallel to the axial direction (X) and has at least one surface (S1, S2) facing the platform (4) with a constant cross-sectional profile perpendicular to the axial direction (X) to form a bearing surface for retaining the vane (1) in a radial direction (R) oriented from the platform to the blades (2, 3).

10 Claims, 2 Drawing Sheets

(51) Int. Cl.
*F04D 29/32* (2006.01)
*F01D 5/14* (2006.01)

(52) U.S. Cl.
CPC ..... *F01D 5/3015* (2013.01); *F05D 2240/30* (2013.01); *F05D 2240/80* (2013.01); *F05D 2240/90* (2013.01); *F05D 2260/30* (2013.01); *F05D 2260/941* (2013.01)

(58) Field of Classification Search
CPC ..... F05D 2260/941; F05D 2240/30; F05D 2240/80; F05D 2260/30
See application file for complete search history.

(56) References Cited

U.S. PATENT DOCUMENTS

| | | | |
|---|---|---|---|
| 2015/0017002 | A1 | 1/2015 | Freeman et al. |
| 2015/0354377 | A1 | 12/2015 | Gimat et al. |

* cited by examiner

Prior Art

MULTI-BLADE VANE FOR A TURBOMACHINE ROTOR AND ROTOR COMPRISING SAME

TECHNICAL FIELD

This invention relates to the field of bladed rotors in the turbomachines, more particularly the case where the vanes are produced individually and fixed on a disk to form the bladed rotor.

BACKGROUND

In particular, a low-pressure turbine rotor is generally composed of several tens or even hundreds of vanes mounted on a disk. Each vane is made up of at least one blade, an attachment to fit into the disk of the rotor and a platform, placed between the two, so as to form the inner face of the duct in which the flow of gas passes through the blades.

Such a rotor can be heavily loaded by a very high rotational speed. The maintenance of the vanes on the rotors and the sealing regarding the gas flow at the platforms are among the problems to be solved when designing these rotors and their vanes.

There are several advantages to having several blades on one vane. Firstly, producing several blades on the same part allows to reduce the production costs of the complete rotor. In addition, gaps are required between each vane for the assembly and to avoid the contacts during thermal expansion. These gaps cause leakage between the duct and the out of duct, which is detrimental to the performance of the turbomachine.

It is therefore well-known to use two-bladed vanes, as presented in the document EP-B1-1447525 where the concept is adapted to adjust the resonance frequencies of the blades.

With reference to FIG. 1, a two-bladed vane 100 according to the prior art comprises two blades 101,102, extending in span along a radial direction R between an inner platform 103 and an outer platform 104 delimiting the passage duct of the flow of gas. The inner platform 103 also makes the connection between the blades 101, 102, and a monobloc attachment root 105 which is inserted between the teeth 106 of the disk of a rotor 107 (shown only in the vicinity of the vane). The dovetail-shaped attachment consists of a bulb 107 placed at the end of a two-part support 108, each of the two parts joining the base of a blade. Since the vane is manufactured by metal casting, in order to avoid a solid area between the two parts of the support 108, a cavity 109 is made between the two parts of the support 108 using a core used in the metal casting method.

The attachment root 105 is substantially centred in the circumferential direction T between the two blades 101, 102, so as to balance the stresses to hold the blades under centrifugal forces. It can be seen in FIG. 1 that this requires both parts of the support 108 to have a non-radial part to reach the base of the blades. The arrows in FIG. 1 schematically show the path of the stresses caused by centrifugal forces along the supports 108 and the blades 101, 102. In the part where the arrows are not aligned with the radial direction R this creates a moment in the support and thus additional stresses. From a dimensioning point of view, the attachment root 105 must hold two blades instead of one, resisting additional stresses due to the offset of the root 105 with respect to the blades. In addition, since the root 105 is penetrated by the core 109, it must be even wider than twice as wide as a single root to hold a single blade.

Another well-known solution would be to have two separate attachment roots under each blade, but the assembly would be highly hyperstatic. Indeed, in the prior art, the vane and the disk are already hyperstatic in operation, because there are two planes of contact. If two normal attachments are provided, there will be four contact planes, thus much more problems of hyperstatism.

In addition, there is a need to minimize the mass of the vanes, to reduce the stresses on the connections to the disk as well as for the overall mass balance.

The purpose of the invention is to propose a solution to minimize the mass of the attachment of a two-bladed vane, in particular by reducing the level of stresses that the attachment of the vanes must withstand during the operation of the rotor.

The invention also aims to avoid too much hyperstatism between the disk and the vane, which would require costly fine adjustments between the attachments of the vane and the fastening teeth on the disk.

The invention also aims to minimize the mass of the assembly of the rotor at the connection to the vanes.

DISCLOSURE OF THE INVENTION

The invention relates to a turbomachine rotor vane comprising a first blade and a second blade arranged to form two successive blades of a bladed rotor, a platform substantially forming an angular wall sector in an axial direction, said two blades being connected to the platform by one of the ends thereof extending substantially in a direction referred to as radial which is substantially perpendicular to said axial direction, and attachment means connected to the platform which are designed to cooperate with fastening means on a disk of the rotor.

Said vane is characterized in that the attachment means comprise two individual supports, each support extending from the platform, in the radial direction, in the extension of one of said two blades, and carrying an attachment member at an end opposite the platform, said attachment member extending substantially parallel to said axial direction and comprising at least one surface facing the platform with a constant cross-sectional profile perpendicular to said axial direction, so as to form a bearing surface for holding the vane in said radial direction oriented from the platform to the blades.

The fact that the attachment member of each support extends parallel to the axial direction with a constant profile of the bearing surface makes it possible to mount the vane according to the invention by sliding the attachment member against teeth of the disk of the rotor in the axial direction.

The fact of placing each support in the extension of each vane allows better alignment of the passage of the stresses to hold the vane between the blades and the supports during the rotation of the rotor. There is therefore no need for an extra thickness in the dimensions of the supports to withstand high torsional moments and this allows a mass saving on the vane compared to the prior art of a two-bladed vane with a central root.

Moreover, when the disk is thus equipped with a succession of vanes such that the blades can be associated two by two with supports which are in their extension, it may be sufficient to provide holding teeth only in every second circumferential interval between the supports. In fact, if the attachment means are symmetrical, one interval out of two corresponds to the presence of the bearing surfaces and the other is empty of holding means.

Thus, this allows to reduce the mass of the holding teeth on the periphery of the disk. Indeed, with respect to single-bladed vanes, the number of equivalent teeth is reduced by two, and compared to two-bladed vanes according to the prior art with a central root, the mass of the teeth is reduced by spreading them apart and reducing their circumferential width.

Finally, from the point of view of holding the vane on the rotating disk, in the case of a two-bladed vane, thus comprising only the first and second blades, the invention makes it possible to limit the hyperstatic nature of the radial maintenance against the centrifugal forces. Indeed, compared to a solution of the prior art for a two-bladed vane with a complete attachment under each blade, the vane according to the invention has only two contact planes instead of four. With four contact planes, manufacturing tolerances would have to be much tighter than the prior art to ensure that one or two of the bearing surfaces are not inoperative.

In addition, the larger spacing of the bearing surfaces is also advantageous for the positioning of the blades of the vane with respect to the disk and thus their positioning in the engine. Indeed, these bearing surfaces, together with the teeth of the disk, define contact surfaces which position the vanes. The greater the distance between the two contact surfaces, the smaller the defects on these surfaces will have a small impact on the angular misalignment of the blades.

Preferably, the bearing surface of the attachment member carried by each support is on a side of the attachment member which is external with respect to the two supports in a circumferential direction perpendicular to said axial and radial directions. In this case, the supports with their attachment member can be slid during assembly between two successive teeth of the disk leaving a gap between the two supports.

The bearing surface itself is generally inclined with respect to the radial direction. Furthermore, in the case of a two-bladed vane, the positioning of the bearing surfaces circumferentially outside the supports contributes to the stability of the connection to the disk with respect to the forces exerted on the vane during the operation of the rotor.

Advantageously, each support comprises a substantially planar web parallel to the axial direction forming said end carrying the attachment member, said web and the attachment member being arranged so as to have a lateral face facing the opposite direction to the other support which is parallel to the axial direction with a constant profile.

In this configuration, a part of the web can also be engaged between the teeth of the disk and thus cooperate with the teeth to participate in the lateral maintenance of the vane.

In a preferred embodiment, the attachment member comprises a tab forming a lug with respect to said web at the end of the support.

This embodiment minimises the mass used to make the attachment of the vane.

Preferably, the blades being offset by a given distance at their junction with the platform in a circumferential direction, perpendicular to said axial and radial directions, said ends of the two supports carrying the attachment member are offset by a distance substantially equal to said given distance.

Thus, the attachments of several successive vanes to the rotor create a repetitive pattern which can cooperate with a uniform distribution of similar teeth around the periphery of the disk of the rotor.

Preferably, the attachment member of each support is positioned in a circumferential direction, perpendicular to said axial and radial directions, on a mean position of the end connected to the platform of the corresponding blade.

In this way, the offsets that the support must take up between the vanes with a curved profile and the bearing surfaces having a straight axial extension are minimized. Thus, this minimises the dimensioning of the supports with respect to the stresses induced by the centrifugal forces.

Advantageously, each support is shaped in such a way that the junction of the support with the platform follows the junction with the platform of the corresponding blade in its evolution along the axial direction.

The vane can advantageously comprise at least one wall connecting the two supports transversely to said axial direction.

Such a wall has a stiffening function. It will avoid deformations of the supports under the centrifugal forces and allows to reduce the thickness of the supports and thus their mass.

The wall may extend radially between the supports from the platform to a line joining radial ends of the attachment members opposite of the platform.

This allows to close the air passage under the platform of the vane between the teeth of the disk.

The invention also relates to a turbomachine rotor comprising vanes as described above.

Advantageously, the disk of said rotor carries on its periphery a succession of similar teeth shaped to cooperate with the attachment means for the vanes, two successive teeth being separated in the circumferential direction by a distance at least equal to the width of a tooth in this direction.

BRIEF DESCRIPTION OF THE FIGURES

This invention will be better understood and other details, features and advantages of this invention will appear more clearly when reading the following description, with reference to the annexed drawings on which.

The members having the same functions in different vanes of alternative embodiments according to the invention are marked with the same references in the figures.

DESCRIPTION OF AN EMBODIMENT OF THE INVENTION

Figure 4:
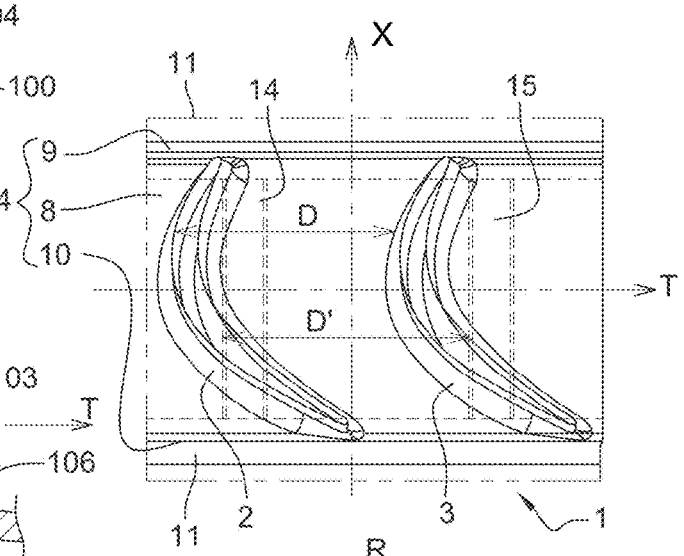
FIG. 4 represents a view in radial projection on the inner platform of the members of a vane according to the invention.
Figure 2:
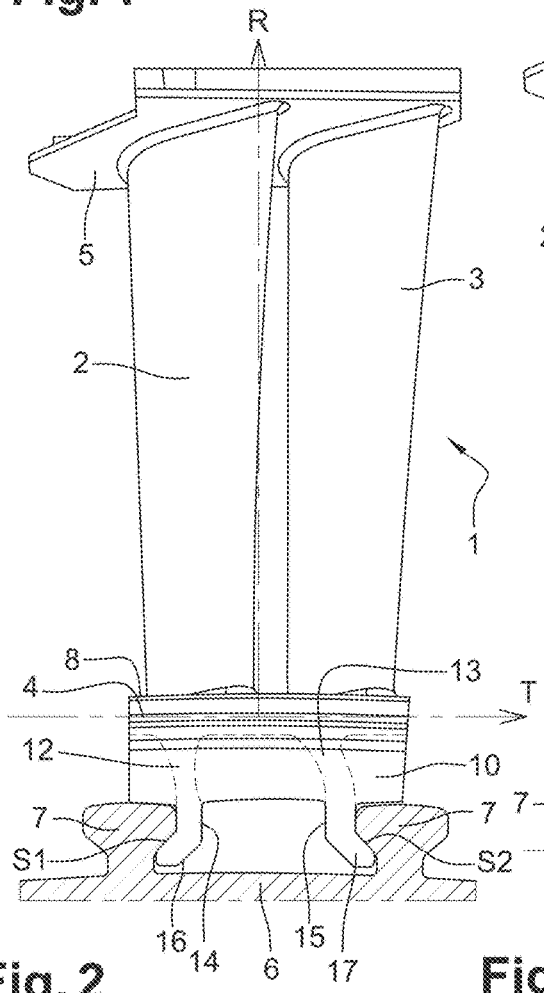
FIG. 2 represents a rear view along the axis of rotation of a two-bladed vane according to the invention.
Figure 3:
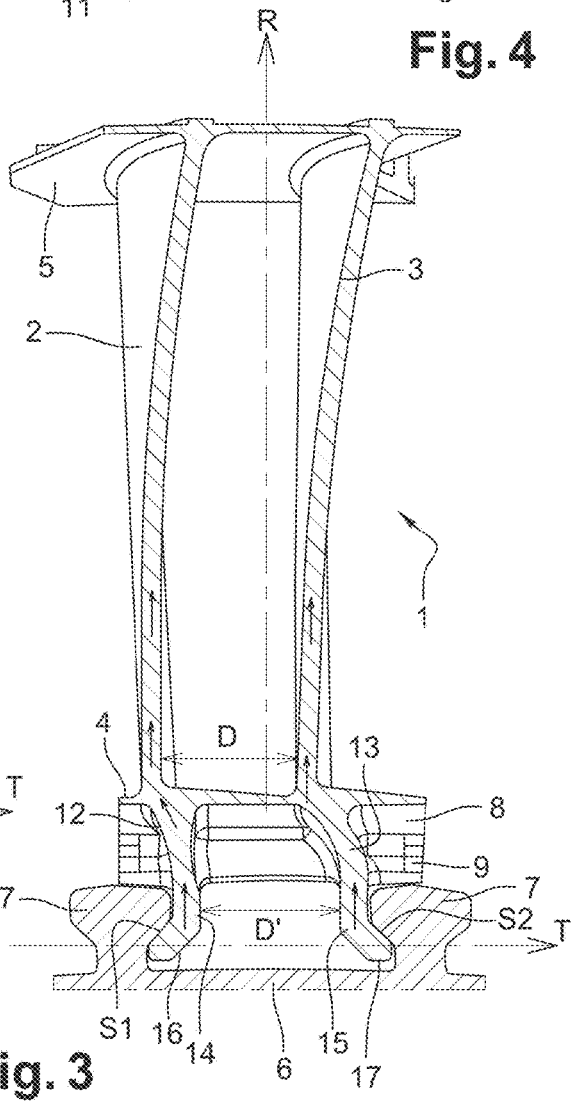
FIG. 3 represents a rear view of the axis of rotation of a two-bladed vane according to the invention in a radial cross section.

With reference to FIGS. 2, 3 and 4, in a preferred embodiment, a turbine vane 1 according to the invention comprises two blades 2, 3 extending in span in a radial direction R between an inner platform 4 and an outer platform 5.

The vane 1 is attached to a rotor disk 6 movable about an axis of direction X (shown in FIG. 4), only a peripheral part of which is shown with the holding teeth 7 of the vane.

The axial and radial directions refer to the rotor axis, the terms inner and outer are understood with respect to the radial direction. The terms upstream and downstream in the axial direction refer to the direction of flow for which the vanes have been designed.

The inner 4 and outer 5 platforms delimit an angular sector of the passage duct of the gas flow around said axis X. The outer platform 5 is not concerned by the invention and may possibly not exist, as is generally the case for the compressor vanes. It is therefore not further described. More particularly, the inner platform 4 is delimited along the circumferential direction T between two axial planes, so as to fit with the platforms of the adjacent vanes in order to ensure continuity of the wall of the duct. The body 8 of the inner platform 4 delimiting the duct has a radial profile determined by the design of the turbine which can be inclined with respect to the radial direction R. In the example, this profile deviates from the axis X of the rotor from the upstream to the downstream. At the axial ends of said body 8, the inner platform 4 here comprises an upstream radial web 9 and a downstream radial web 10 which extend radially so as to come into contact with the holding teeth 7 on the disk 6 at the same distance from the axis X.

Here, the upstream web 9 and the downstream web 10 have a holding function of the vane 1, on the one hand to block its movement in the radial direction towards the axis X, and on the other hand to block the rotation about a direction parallel to the axis X. The inner platform 4 generally comprises devices attached to the upstream 9 and downstream 10 webs, e.g. annular spoilers 11, for sealing with the stator elements of the turbine which surround the rotor in the axial direction.

The two blades 2, 3, have a curved profile inclined with respect to the axial direction X which can evolve along their span in the radial direction R. FIG. 4 shows the shape of this profile at the base of the blades 2, 3, at their junction with the platform 4. The geometries of the two blades 2, 3, are similar with an angular offset corresponding to the design of the rotor and the number of vanes to be installed in it. The bases of the blades 2, 3 are therefore offset by a certain distance D at the inner platform 4.

The attachment of the vane 1 to the disk 6 here comprises two individual supports 12, 13 which are connected to the body 8 of the platform 4 and extend from the latter in the radial extension of one of the blades 2, 3, having substantially the same extension as said blades 2, 3 in the axial direction X. Each support 12, 13 ends here, on the side opposite the platform, with an axial web 14, 15, parallel to the radial direction R, which is connected to a tab 16, 17, parallel to the axial direction X and inclined with respect to the radial direction, which tab forms the free end of the support. Said tab 16, 17 deviates laterally outwards from the axial web 14, 15, forming, in cross section, an end lug, so that its outer lateral surface S1, S2, faces the platform 4. The bearing surface S1, S2 is generally inclined with respect to the radial direction. The angle of inclination depends on the designed made by the person skilled in the art with respect to the geometry of the turbine and operating constraints. Classically it takes values between 40 and 50°, but can be outside this range. Each tab 16, 17 thus forms an attachment member of the vane 1 and the surfaces S1, S2 form bearing surfaces for holding the vane in the radial direction R oriented from the platform to the blades. The axial webs 14, 15 of the supports 12, 13 and the end tabs 16, 17 cooperate with the teeth 7 of the disk 6 to hold the vane 1 according to an operation which will be described later.

The axial webs 14, 15 of the ends of each support 12, 13 are centred on an average position of the bases of the blades 2, 3 on the platform 4 in the circumferential direction T and are therefore offset in this direction by a distance D' substantially equal to the offset D between the bases of said blades 2, 3. Here, the assemblies formed by the axial webs 14, 15 and the end tabs 16, 17 are substantially symmetrical with respect to an axial plane passing through the middle of the supports 12, 13.

Each support 12, 13 has a three-dimensional shape between the axial web 14, 15, and the platform 4, to follow the profile of the base of the corresponding blade 2, 3 at its junction with the body 8 of the platform 4.

In correspondence, the disk 6 of the rotor comprises on its periphery a ring of similar teeth 7 which are offset in the circumferential direction T by a distance substantially equal to twice the offset distance D between the bases of the blades 2, 3, so that there are half as many teeth 7 as there are blades 2, 3, on the rotor.

Each tooth 7 extends here parallel to the axis X over a distance corresponding substantially to the distance between the upstream 9 and the downstream 10 webs of the platform, with a constant transverse profile. In this way, the vane 1 described above can be installed between two successive teeth 7 by sliding, in the axial direction X, the axial webs 14, 15 of the supports 12, 13 and the end tabs 16, 17, between two successive teeth 7. Well-known devices, not described here, then make it possible to hold the vane 1 in its axial position with respect to the rotor. These devices are not concerned by the invention.

The profile of each tooth 7 has the shape of a bulb. Starting from the outer surface of the disk 6, the tooth therefore comprises a part of constant given thickness followed by a widening. The shape of this widening is defined in such a way as to form, on one side of the tooth 7, a surface facing the disk 6 which is in contact with the bearing surface S1 connected to one of the supports 12 of the vane 1 and to form, on the other side of the tooth, another surface facing the disk 6 which is in contact with the bearing surface S2 connected to the other of the supports 13 of an adjacent vane, similar to the vane 1. When the attachment members 16, 17, of the two supports 12, 13 of the vanes are symmetrical, as described above, the profile of the teeth 7 is symmetrical with respect to a radial median plane of the tooth.

Finally, the tooth 7 comprises a radially outer surface which is substantially flat or forms a portion of a circular cylinder centred on the axis X of the rotor. Thus, the free edges of the upstream 9 and downstream 10 webs of the platform 4 can be supported on it when the engine is stopped. As previously mentioned, the bearing of the upstream 9 and downstream 10 webs blocks the radial movements of the vane 1 towards the disk 6, so as to maintain the correct positioning of the vane 1 on the rotor.

The bearing surface S1, S2 of the end tab 16, 17, carried by each support 12, 13 is designed to take up about half of the centrifugal forces applied by the vane 1, i.e. substantially those corresponding to one of the blades 2, 3. A support 12, 13 with its end tab 16, 17 must therefore be dimensioned substantially to support the stresses imposed by a blade. Furthermore, as shown by the arrows in FIG. 3, the three-dimensional part of the support 12, 13 takes up these stresses towards the base of the corresponding blade 2, 3 with a small radial inclination since the aim here is essentially to compensate for the curved shape of the profile of the blade 2, 3 but not a circumferential offset of a half interval with the said blade. The dimensioning of the supports 12, 13 and of the end tab 16, 17, therefore results in giving them a thickness in the transverse direction slightly greater than half the thickness that would be necessary for the root of a single-bladed vane but considerably less than half that for a single centred root for a two-bladed vane. This saves mass on the attachment means to the disk 6 for the vane 1.

It should be noted that, as far as resistance to centrifugal forces is concerned, the vane 1 is held by the contacts of only two bearing surfaces S1 and S2, each extending at an angle to the radial direction, on the outside of a support 12, 13 in the circumferential direction T. This limits the hyperstatism between the vane and the disk. In addition, the two supports 12, 13 being spaced apart, the said bearing surfaces S1, S2 are themselves spaced apart and located close to the edges of the vane 1 in the circumferential direction T. This improves the stability of the assembly under the stress of the centrifugal forces, compared with a single attachment assembled in the centre of the vane.

Figure 1:
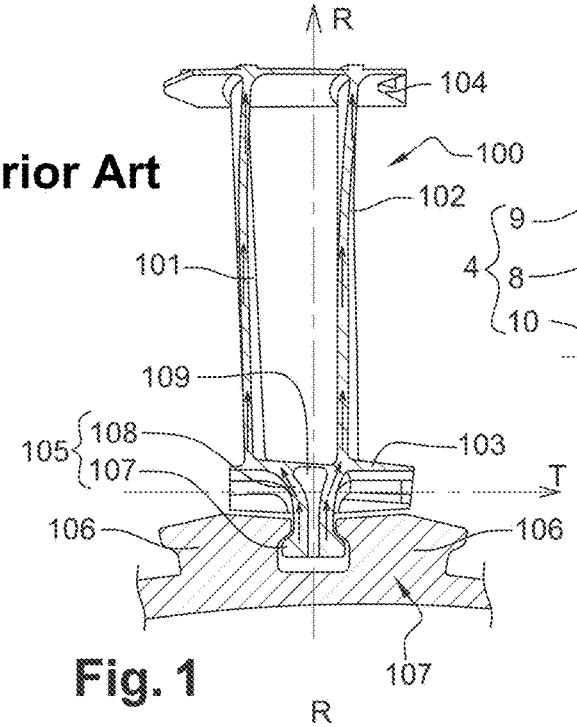
FIG. 1 represents a rear view along the axis of rotation of a two-bladed vane according to the prior art in a radial cross section.
Figure 5:
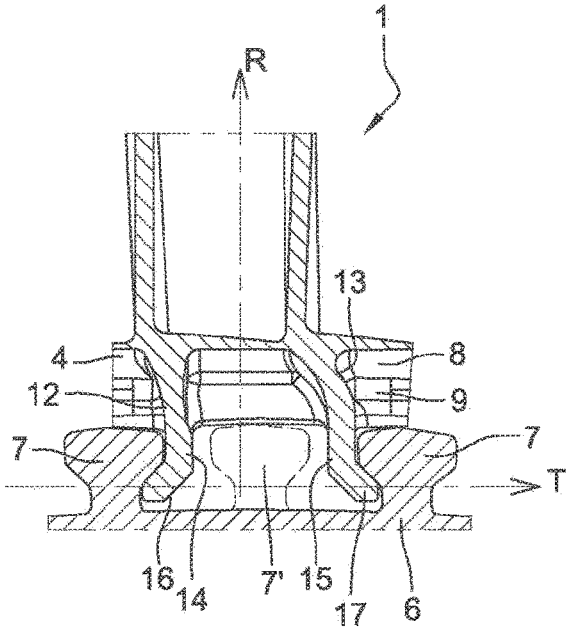
FIG. 5 represents a detail of FIG. 3 with the representation of a fictitious tooth removed by the invention with respect to certain embodiments according to the prior art.

The invention also allows a mass gain on the disk 6. It can be seen in FIGS. 3 and 4 that the space between the two supports 12, 13 of a two-bladed vane 1 is free of tooth. On the other hand, by repetition from a vane 1 to another, each tooth 7 of the disk 6 occupies a space extending between two blades in the circumferential direction T, one belonging to one vane, the other to the adjacent vane. Thus, with respect to the well-known solution of a two-bladed vane with a central root, the teeth 7 of a disk adapted to the vanes according to the invention are considerably less wide than for a disk adapted to two-bladed vanes with a single root, as can be seen by comparing FIG. 3 and FIG. 1. Moreover, FIG. 5 illustrates the mass gain obtained in comparison with the use of single-bladed vanes or two-bladed vanes with 2 attachments corresponding to the prior art and which would therefore have 4 contact surfaces between the disk and the vane. The teeth with the single-bladed vanes would have a lesser thickness in the circumferential direction T but would be twice as numerous since it would be necessary to add the tooth 7' indicated in dotted lines to hold each vane, which results in the fact that, overall, the invention makes it possible to gain on the mass of the teeth of the disk.

Figure 6:
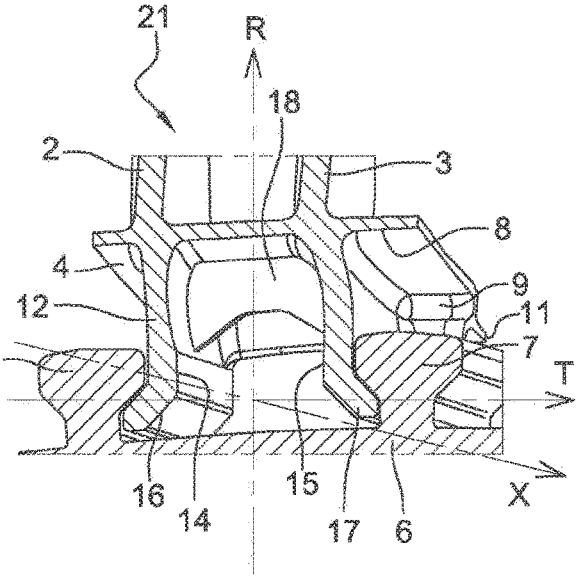
FIG. 6 represents a perspective view of the rear side of a further improvement of the two-bladed vane according to the invention in a radial cross section.
Figure 7:
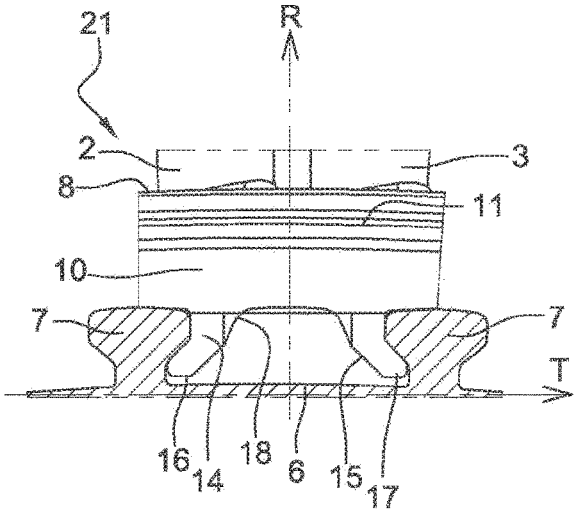
FIG. 7 represents a part of the rear view along the axis of rotation of an alternative embodiment with respect to the vane of FIG. 6.

According to an improvement of the invention, with reference to FIG. 6, the vane 21 has in addition one or more transverse stiffening webs 18 connecting the two supports 13, 14. Advantageously, such a stiffening web 18 extends radially from the body 8 of the platform 4. In the example shown in FIG. 6, it closes the space between the supports 12, 13 only in the three-dimensional part, leaving the space between the axial webs 14, 15 free. As shown in FIG. 7, such an embodiment leaves free an air passage area under the platform 4 and the upstream 9 and downstream 10 webs, between the teeth 7 of the disk 6 of the rotor.

Figure 8:
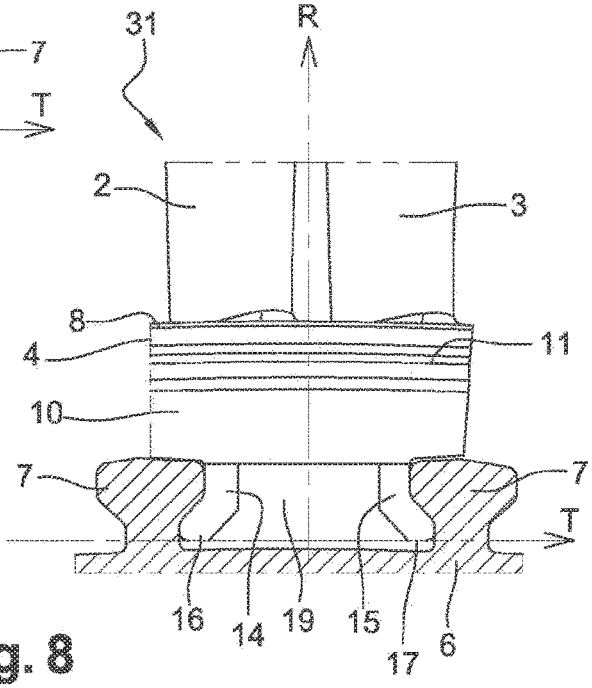
FIG. 8 represents a part of the rear view of an alternative embodiment with respect to the vane of FIG. 6.

In an alternative embodiment, shown in FIG. 8, the vane 31 has at least one stiffening web 19 which extends to the radial end of the attachment tabs 16, 17 carried by the supports 12, 13, following the periphery of the disk 6, so as to close the axial passage of the air between the teeth 7 under the platform 4 and the upstream and downstream webs 9 and 10.

The description of the embodiments of the invention made in this document is not restrictive. The vane described here is two-bladed but one can consider vanes comprising a succession of pairs of blades with their supports in the extension. In this case, however, the assembly of the bearing surfaces on the teeth becomes hyperstatic for the vane, thus more delicate to adjust. Other embodiments of the means of connection with the disk, not shown, can also be considered. For example, the radial blocking of the vane towards the axis can be ensured by a member carried by the supports which bears on the disk 6 or on the radial apex of the teeth 7. The inner platform 4 may then not have an upstream or downstream webs with a holding function. The invention has been described in the case of a turbine vane, but it may also relate to vanes adapted to other types of rotors, such as compressor rotors for example. Furthermore, an attachment member at the end of the supports 12, 13 other than a tab forming a bend with respect to the axial web 14, 15, can be used to produce the bearing surfaces S1, S2. It can be made, for example, by spoilers deviating from the surface of the web. The shape of the teeth on the disk will then be adapted to the shape of the attachment members used on the vane.

The invention claimed is:

1. A vane for a turbomachine rotor comprising a first blade and a second blade arranged to form two successive blades of a bladed rotor, a platform forming an angular wall sector in an axial direction, said two blades being each connected to the platform by one of the ends thereof by extending in a radial direction which is perpendicular to said axial direction, and attachment means connected to the platform to cooperate with fastening means on a disk of the bladed rotor, wherein the attachment means comprise two individual supports, each support extending from the platform, in the radial direction, in the extension of one of said two blades, and carrying an attachment member at an end opposite said platform, said attachment member extending parallel to said axial direction and comprising at least one surface facing the platform with a constant cross-sectional profile perpendicular to said axial direction, so as to form a bearing surface for holding the vane in said radial direction oriented from the platform to the blades.

2. The vane according to claim 1, wherein the bearing surface of the attachment member carried by each support is on a side of the attachment member which is external with respect to the two supports in a circumferential direction perpendicular to said axial and radial directions.

3. The vane according to claim 1, wherein each support comprises a planar web parallel to the axial direction forming said end carrying the attachment member, said web and the attachment member being arranged so as to have a lateral face facing the opposite direction to the other support which is parallel to the axial direction.

4. The vane according to claim 1, wherein the attachment member comprises a tab forming a lug with respect to the planar web at the end of the support.

5. The vane (1) according to claim 1, wherein the blades are offset by a given distance at their junction with the platform in a circumferential direction, perpendicular to said axial and radial directions, said ends of the two supports carrying the attachment member are offset by a distance equal to said given distance.

6. The vane according to claim 1, wherein the attachment member of each support is positioned in a circumferential direction, perpendicular to said axial and radial directions, on a mean position of the end connected to the platform of the corresponding blade.

7. The vane according to claim 1, wherein each support is shaped in such a way that the junction of the support with the platform follows the junction with the platform of the corresponding blade in its evolution along the axial direction.

8. The vane according to claim 1, wherein it comprises at least one wall connecting the two supports transversely to said axial direction.

9. The vane according to claim 8, wherein said wall extends radially between the supports from the platform to a line joining radial ends of the attachment members opposite to the platform.

10. A turbomachine rotor comprising vanes according to claim 1.

* * * * *